United States Patent [19]

Cotton

[11] 3,936,561

[45] Feb. 3, 1976

[54] ANTI-DUSTING TREATMENT OF TEXTILES

[75] Inventor: James F. Cotton, West Point, Ga.

[73] Assignee: West Point-Pepperell, Inc., West Point, Ga.

[22] Filed: Apr. 2, 1974

[21] Appl. No.: 457,347

[52] U.S. Cl. ..... 428/264; 8/115.6; 427/390; 428/274

[51] Int. Cl.[2] ..... B32B 7/00; B32B 23/00

[58] Field of Search..... 117/139.4, 139.5 A, 143 A, 117/138.8 A, 56, 76 T, 138.8 F; 8/115.6; 252/8.9; 260/2 EP; 428/264, 274; 427/324, 390

[56] References Cited

UNITED STATES PATENTS

| | | | |
|---|---|---|---|
| 3,164,560 | 1/1965 | Suter | 117/161 UE |
| 3,427,121 | 2/1969 | Frick et al. | 8/115.6 |
| 3,638,308 | 2/1972 | Fischbein et al. | 117/161 UE |
| 3,676,052 | 7/1972 | Harper et al. | 08/115.6 |

*Primary Examiner*—Harry J. Gwinnell
*Assistant Examiner*—Sadie L. Childs
*Attorney, Agent, or Firm*—Cushman, Darby & Cushman

[57] ABSTRACT

Durable press fabrics are treated with high molecular weight polyethylene glycol to reduce their tendency to liberate dust in factories.

1 Claim, No Drawings

ANTI-DUSTING TREATMENT OF TEXTILES

The present invention relates to a treatment for durable press fabrics to recuce their tendency to liberate dust in factories in which they are used.

Durable press fabrics are fabrics which are composed, at least partially, of cellulosic fibers which have been cross-linked by textile resins. The resin treatment, as more fully described below, tends to make fibers brittle. During handling of the fabric, either in a textile mill or in a garment factory, brittle fibers at the surface of the fabric break, and form dust which floats through the air and settles on machines as well as the floor. Dust particles liberated in this way may be inhaled, and concern has been expressed about the possibility of hazards to the health of workers who are exposed to it regularly.

The present invention provides a low cost treatment which substantially reduces the formation of dust from such fabrics. Briefly, it consists of applying polyethylene glycol of molecular weight at least approximately 100,000 in an amount which is sufficient to reduce dust.

The fabrics with which the present invention is concerned may be woven, knitted or non-woven. They contain cross-linkable cellulosic fibers, e.g. regenerated cellulose (rayon) or cotton, optionally blended with other fibers, either natural or synthetic. Most typically, the fabrics comprise cotton or rayon blended with 0-60% of the total weight of the blend of polyester (e.g. polyethylene terephthalate) fibers. Fiber diameter is not of critical importance, but typically is 1.5 to 6 denier. Fabric weight may typically be 3 to 12 ounces per square yard.

These fabrics acquire durable press characteristics by being treated with cross-linking textile resins, usually aminoplasts. The term aminoplasts refers to hardenable amine-aldehyde precondensates of the type which are either freely soluble in water or soluble therein to a limited but substantial extent. Included are reaction products of nitrogenous compounds, e.g., nitrogenous bases with aldehydes which are either water soluble or water dispersible. Typical nitrogenous compounds are melamine, guanamines and other triazines, urea, ethylene urea, propylene urea, thiourea, guanadine, biuret, dicyandiamide, urons, triazones and various derivatives thereof. Also included in the term nitrogenous compounds are cyclic imines such as ethylene imine and propylene imine. The aldehyde is selected from that group forming water soluble or dispersible condensation products with nitrogenous bases, but formaldehyde is the preferred aldehyse. The aminoplasts may be etherified or partially etherfied with methyl, ethyl, or higher alcohols. Mixtures of aminoplasts may be used. Aminoplasts are usually applied after the fabric is formed by weaving, etc., and generally after scouring to remove sizes, after dyeing, printing, etc. Typical amounts of aminoplast resins used on the fabrics are 2 to 10% based upon the weight of the dry fabric. The fabrics containing these aminoplasts are cured to impart crease recovery, wrinkle resistance and related properties. Frequently the curing is carried out after drying at 100° to 175°C for ½ to 5 minutes, by heating at temperatures in the range 150° to 200°C for ½ to 5 minutes. In some cases, such a cure is only partial and it is followed by a final cure, for instance after a garment has been made, at 150° to 200°C for ½ to 15 minutes. In some cases, the first cure can be carried out under moist conditions as described in Getchell U.S. Pat. No. 3,138,802 and Cotton U.S. Pat. No. 3,374,107. The present invention also is applicable to fabrics which have been cross-linked with aldehydes such as formaldehyde, as described for instance in Cotton U.S. Pat. Nos. 3,420,696 and 3,622,261.

The polyethylene glycol used in the present invention is a water soluble polymer of ethylene oxide of high molecular weight. The molecular weight preferably is about 100,000. Polyethylene glycol of molecular weight 20,000 is essentially ineffective for dust control purposes. At a molecular weight of 33,000, polyethylene glycol provides marginal dust control, and there is good dust control at a molecular weight of 100,000 or more. On the other hand, it is preferable for practical reasons not to use a polyethylene glycol whose molecular weight is any higher than necessary. This preference is based upon the practical problems of handling the polymer. As will be recognized by persons skilled in the art, the viscosity of a solution of polyethylene glycol depends on its molecular weight as well as on concentration and temperature. Excessive solution viscosity may increase the difficulties of physically handling the material and may also interfere with spreading and penetration of the solution. For this reason, it is preferred that the molecular weight is approximately 100,000.

The polyethylene glycol is most conveniently applied to the fabric as an aqueous solution. The concentration of polyethylene glycol in the solution is not critical, apart from the problems of high viscosity if the concentration is too high, as mentioned above. If the concentration is very low, excessive amounts of water must be applied with the polyethylene glycol, and the removal of such quantities of water increases the energy cost to dry the fabric. Good results have been obtained with polyethylene glycol of molecular weight 100,000, using aqueous solutions containing 0.7% by weight of the polymer.

The solution may be applied by impregnation and in fact it may be applied with the durable press resin. However, since the principal cause of dusting is the breakage of surface fibers, spray application may be used with good effect. Spraying may be achieved with pneumatic nozzles, with relatively high air to solution ratios which produce an aerosol or fog having little driving potential for deposition on the fabric. A vacuum slot should be used to pull such a fog against the fabric. The polyethylene glycol is applied in the last finishing operation, usually before curing the durable press resin. However, if the fabric is washed, after curing, the polyethylene glycol may be applied thereafter since the afterwash would remove it prematurely.

The amount of polyethylene glycol deposited on the fabric should be sufficient to control dusting. This amount will vary from lot to lot of fabric, depending upon the kind of fabric, other possible treatments which may have been used and a wide variety of other factors. Generally, it is not practical on a production basis to assess the dusting potential of each lot of fabric prior to finishing it, or to adjust the amount of polyethylene glycol for each lot. Therefore, it is preferable to apply an amount of polyethylene glycol which is sufficient for fabrics having a high dusting potential. On the other hand, little is to be gained by applying larger amounts, simply because such larger amounts increase the cost of the treatment. On this basis, about 0.4% by weight polyethylene glycol, based on the weight of the fabric, is believed to be appropriate for those fabrics most prone to dusting. Such an add-on can be achieved by applying a solution containing about 0.7% by weight of polyethylene glycol, with a wet pickup of about 60%. Lesser amounts of polyethylene glycol are applied to the fabric in the case of spray application in which the polyethylene glycol mainly stays on the surface. In such cases, an add-on of 2–3% by weight, based on the weight of a fabric, of a 2% solution of polyethylene glycol, is sufficient. This gives an add-on of about 0.04 to 0.06% by weight of the fabric. The cost advantage achieved in this way, however, has to be balanced against the cost of a separate spray application.

The solution used to apply the polyethylene glycol may contain other conventional components, for example the cross-linking resin itself, various reactants, the catalysts normally used to effect cross-linking of the aforesaid resin, softeners, tints, bluing, fabric brighteners and hand builders.

Fabrics finished without the treatment of the present invention may cause appreciable accumulation of fibrous dust in all areas where they are handled after they have been finished. For instance, the fabric normally is packaged for shipment after finishing. In the area where the packaging is performed, it is common for equipment to be covered with a fine dust which also accumulates on the floor as a soft, billowing material. There also is typically appreciable fibrous dust in the air in such areas, and dust accumulates on workers. Similar difficulties are observed in cutting and sewing areas of a garment factory as well as product packaging areas. On the other hand, fabric processed according to the present invention can be handled without these problems. Any small amount of fibrous dust quickly falls to the floor without hanging suspended in the air or accumulating in billowing rolls. The reduction in dusting achieved by this process provides safer, more comfortable working conditions in all of the foregoing areas.

The invention is illustrated by the following example, all percentages being by weight. An aqueous solution was formed containing the following components:

| | |
|---|---|
| Polyethylene Glycol, molecular weight about 100,000 (Polyox WSRN-10) | 0.7% |
| Methylcarbamate-formaldehyde reactant | 20 % |
| 30% magnesium chloride solution | 4 % |
| Emulsified polyethylene softener | 3 % |
| Wetting agent (linear alcohol-ethylene oxide condensate) | 0.2% |

A bedsheet fabric was treated with this solution. The fabric was composed of 50% polyethylene terephthalate fibers and 50% cotton and had a weight of 3.8 ounces per square yard. It was saturated and squeezed to give a 60% wet pick-up of the foregoing solution. Then it was dried by heating in air at a temperature of 175°C for 1½ minutes and then it was cured by heating on a hot surface whose temperature was 195°C for ½ minute. The fabric received no further wet finishing.

It will be appreciated that the invention has been illustrated by reference to preferred materials and processing conditions. No limitation thereto is intended, as it will be appreciated that various changes may be made by persons skilled in the art without departing from the invention.

What is claimed is:

1. In a durable press cellulosic fabric which has been treated with a durable press cross-linking textile resin and thereafter cured, the improvement in which the tendency of the treated fabric to form dust has been reduced by applying to the fabric a dust-inhibiting amount of polyethylene glycol whose molecular weight is at least about 100,000.

* * * * *